US007571997B2

(12) United States Patent
Nakamura

(10) Patent No.: US 7,571,997 B2
(45) Date of Patent: Aug. 11, 2009

(54) INKJET RECORDING DEVICE AND INKJET RECORDING HEAD HAVING CURRENT PLATES FOR REGULATING INK FLOW

(75) Inventor: Hirofumi Nakamura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 520 days.

(21) Appl. No.: 11/205,487

(22) Filed: Aug. 17, 2005

(65) Prior Publication Data

US 2006/0152555 A1 Jul. 13, 2006

(30) Foreign Application Priority Data

Jan. 11, 2005 (JP) ..... 2005-003463

(51) Int. Cl.
*B41J 2/19* (2006.01)
*B41J 2/45* (2006.01)
*B41J 2/175* (2006.01)

(52) U.S. Cl. ..... 347/92; 347/70; 347/85

(58) Field of Classification Search ..... 347/94, 347/92, 68, 93; 137/833
See application file for complete search history.

(56) References Cited

U.S. PATENT DOCUMENTS 4,301,459 A * 11/1981 Isayama et al. ..... 347/19
6,099,111 A * 8/2000 Chang ..... 347/94
6,378,996 B1 * 4/2002 Shimada et al. ..... 347/70
6,520,633 B2 * 2/2003 Nakamura ..... 347/93
6,883,906 B2 * 4/2005 Silverbrook ..... 347/94
2004/0114004 A1 * 6/2004 Taira ..... 347/87

FOREIGN PATENT DOCUMENTS

JP 61169254 A * 7/1986
JP 02111550 A * 4/1990
JP 03284949 A * 12/1991
JP 04-235057 8/1992
JP 09-262980 10/1997
JP 2001-129988 5/2001
JP 2002-254631 9/2002

* cited by examiner

*Primary Examiner*—Matthew Luu
*Assistant Examiner*—Shelby Fidler
(74) *Attorney, Agent, or Firm*—Fildes & Outland, P.C.

(57) ABSTRACT

In the head of an inkjet recording device, current plates are arranged along each row and between each row of supply openings. One end and the other end of each current plate do not both contact a side wall of an ink pool chamber, and a gap is formed there. Ink injected from an injection port flows along an ink channel formed by the current plates, and is sent to a pressure chamber via an ink supply path from each supply opening. The ink from the ink pool chamber flows in a regular manner and no stagnation is generated, and bubbles are smoothly eliminated.

13 Claims, 18 Drawing Sheets

INKJET RECORDING DEVICE AND INKJET RECORDING HEAD HAVING CURRENT PLATES FOR REGULATING INK FLOW

CROSS-REFERENCE TO RELATED APPLICATION

This application claims priority under 35 USC 119 from Japanese Patent Application No. 2005-003463, the disclosure of which is incorporated by reference herein.

BACKGROUND OF THE INVENTION

1. Field of the Invention

The present invention relates to an inkjet recording head and an inkjet recording device.

2. Description of the Related Art

An inkjet recording head has components configured to supply ink from an ink pool chamber to each pressure chamber. The ink sent from ink tanks is injected into the ink pool chamber from a fill port.

When filling the ink, there are instances where bubbles remain in the ink pool chamber. Residual bubbles can have a negative impact on the ink discharging characteristics of an inkjet recording head.

Accordingly, there have been proposals for an inkjet head configuration where a current plate is arranged at the entrance of an ink supplying path that is communicated with the pressure chambers (see, for example, the Official Gazette of Japanese Patent Application Laid-Open (JP-A) No. 4-235057).

Further, there have been proposals for a configuration where current plates (i.e., protrusions) are provided at both ends of an ink pool chamber so as to reduce the area of the flow path and increase the speed of flow, making it easier to eliminate bubbles (see, for example, the Official Gazette of JP-A No. 2002-254631).

Further, a configuration has been proposed where a rib and current plate that guide ink are provided within an ink pool chamber (see, for example, the Official Gazettes of JP-A No. 2001-129988 (FIG. 4) and JP-A No. 9-262980 (FIG.1 )).

In recent years, there have been increasing trends in the speeding up of inkjet recording devices. For this reason, inkjet recording heads have been lengthened, and inkjet recording heads that can form images in wide regions in shorter time, due to increasing the number of nozzles per head and arranging them in matrix-shaped rows, are known.

An inkjet recording head configuration where nozzles are arranged in a matrix pattern has been proposed in Japanese Patent Application No. 2004-144544. A vibration plate forming one part of the pressure chambers is placed in between, and an ink pool chamber that pools ink supplied to the pressure chamber is provided at the pressure chamber and at the opposite side thereof.

Nonetheless, as shown in FIG. 17, the shape of the ink pool chamber 1000 of the inkjet recording head recited in Japanese Patent Application No. 2004-144544 is two-dimensionally wide, and there are cases where it is made into a box-shaped form, such as that shown in FIG. 18. With an ink pool chamber 1000 of this form, the flow of ink (R arrow) injected from the ink injection port 1002 becomes irregular, and the flow velocity distribution of the ink within the ink pool chamber 1000 becomes uneven. For this reason, it is easy for a stagnant portion Y where the ink flow stagnates to be generated. Bubbles accumulate in this stagnant portion Y at the time of the initial filling of the ink, and when performing a recovery operation, so it has typically taken time to eliminate bubbles from the ink pool chamber 1000.

It should be noted that the configurations recited in the above-mentioned Official Gazettes of JP-A No. 4-235057, JP-A No. 2002-254631, JP-A No. 2001-129988, and JP-A No. 9-262980 all relate to inkjet recording head ink pool chambers where the nozzles are aligned in straight lined forms. Accordingly, the size and structure of the ink pool chamber 1000, such as that shown in FIG. 17 in the configuration of Japanese Patent Application No. 2004-144544, are completely different. For this reason, the configurations recited in the Official Gazettes of JP-A No. 4-235057, JP-A No. 2002-254631, JP-A No. 2001-129988, and JP-A No. 9-262980 cannot be applied to the ink pool chamber 1000, and even if they can be applied, a sufficient effect cannot be expected.

SUMMARY OF THE INVENTION

There is a demand for an inkjet recording head in which nozzles are arranged in a matrix pattern, a vibration plate forming one part of the pressure chambers is placed in between, and an ink pool chamber that pools ink supplied to the pressure chamber is provided at the pressure chamber and at the opposite side thereof, where bubbles are smoothly eliminated.

The inkjet recording head of a first aspect of the present invention is provided with multiple nozzles that are arranged in a matrix pattern and discharge ink droplets; multiple pressure chambers that are communicated with each of the nozzles and into which ink is filled; a vibration plate forming a portion of the pressure chambers; a piezoelectric element that displaces the vibration plate; and an ink pool chamber that is provided at a side opposite to the pressure chambers with the vibration plate placed between them and which accumulates ink supplied through ink supply paths communicated with each pressure chamber. The ink pool chamber is provided with an injection port that injects ink into the ink pool chamber; multiple supply openings of the ink supply paths provided at an undersurface of the ink pool chamber; and a current plate, which is provided along the supply opening, that forms a channel for ink injected from the injection port.

In the inkjet recording head of the present invention, the current plates are arranged in the ink pool chamber along the supply openings. The current plates form channels for the ink injected from the injection port.

Accordingly, when, for example, in an ink filling operation where ink is suctioned from the nozzles of the inkjet recording head and ink is filled, the ink inside the ink pool chamber flows smoothly without stagnation. Accordingly, bubbles do not accumulate in the ink pool chamber and are smoothly eliminated.

The second aspect of the present invention is that an inkjet recording device is provided with the inkjet recording head of the first aspect of the present invention.

DETAILED DESCRIPTION OF THE INVENTION

Figure 1:
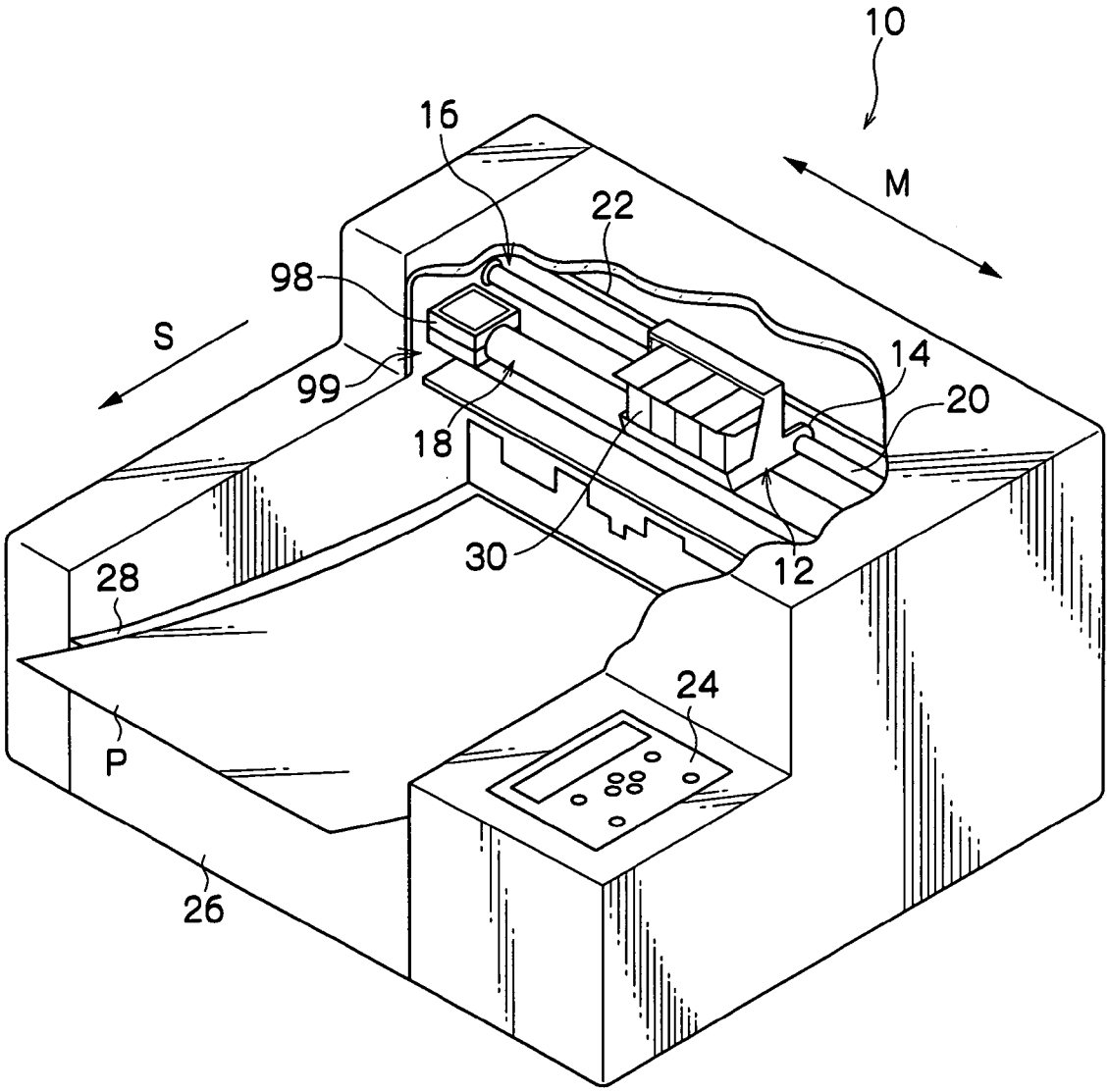
FIG. 1 is a schematic perspective drawing showing an inkjet recording device.

Below, the embodiments of the present invention will be explained in detail while referring to the drawings. Explanations will be made where a recording paper P acts as the recording medium. Further, the conveying direction of the recording paper P in an inkjet recording device 10 is the sub-scanning direction indicated with an S arrow, and the direction perpendicular to the conveying direction is the main scanning direction indicated with an M arrow. Furthermore, when a TOP arrow and BOTTOM arrow appear in the drawings, these respectively indicate the top direction and bottom direction, and references to "up" and "down" correspond to each of the aforementioned arrows.

Firstly, a general outline of the inkjet recording device 10 will be explained.

As shown in FIG. 1, the inkjet recording device 10 is provided with inkjet recording units 30 (i.e., inkjet recording heads 32) one each for black, yellow, magenta, and cyan, and these are mounted on a carriage 12. A pair of brackets 14 is provided so as to protrude towards the upstream side of the conveying direction of the recording paper P of this carriage 12, and circular holes 14A are provided in the brackets 14 (see FIG. 2). Then a shaft 20 is provided so as to span across in the main scanning direction and inserted through the holes 14A.

A drive pulley (not shown) comprising a main scanning mechanism 16 and a driven pulley (not shown) are also arranged at the sides of both ends of the main scanning direction. A part of a timing belt 22, which is wound around this drive pulley and driven pulley and which runs in the main scanning direction, is fixed to the carriage 12. Accordingly, this is configured such that the carriage 12 is supported to be movable back and forth in the main scanning direction.

A paper-feeding tray 26 in which a pack of recording papers P are placed inside prior to image printing is also provided in the inkjet recording device 10. A paper ejection tray 28, onto which a recording paper P on which an image was printed with the inkjet recording head 32 is ejected, is provided on top of this paper-feeding tray 26. A sub-scanning mechanism 18 comprising conveying rollers and ejecting rollers that convey the recording papers P fed from the paper-feeding tray 26 one at a time in the sub-scanning direction at a preset pitch is also provided.

Besides the above, the inkjet recording device 10 is also provided with components such as a control panel 24 for performing various settings for printing and a maintenance station 99.

Figure 2:
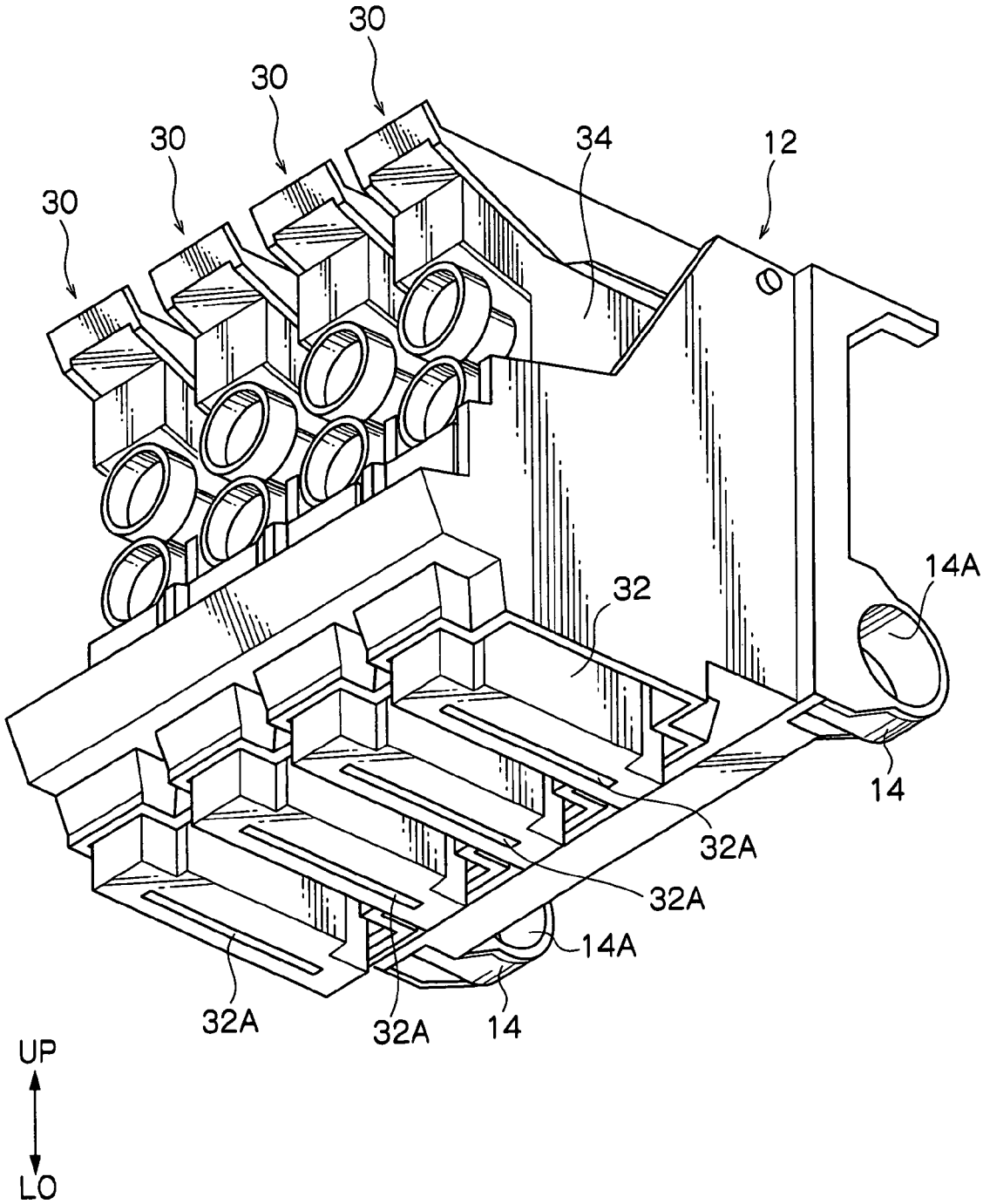
FIG. 2 is a schematic perspective drawing showing an inkjet recording unit mounted on a carriage.

Further, as shown in FIG. 2, the inkjet recording units 30 for each color uniformly comprises an inkjet recording head 32 and an ink tank 34 that supplies ink thereto. Multiple nozzles 56 (see FIG. 3) formed in ink-discharging surfaces 32A in the centers of the undersurfaces of the inkjet recording heads 32 are mounted on top of the carriage 12 so as to face the recording paper P. Accordingly, while the inkjet recording heads 32 are moved by the main scanning mechanism 16 in the main scanning direction, the nozzles 56 selectively discharge ink droplets on the recording paper P, whereby a portion of an image based on image data is recorded in a preset band region.

Next, once one movement in the main scanning direction is completed, the recording paper P is conveyed at a preset pitch in the sub-scanning direction by the sub-scanning mechanism 18. While the inkjet recording heads 32 (i.e., the inkjet recording units 30) move once again in the main scanning direction (i.e., the direction opposite of the previously described direction) a portion of an image based on image data is recorded at the next band region. By repeating this type of operation multiple times, the entire image is recorded in full color on the recording paper P based on image data.

The above-described maintenance station 99 is provided outside the scope of printing, and comprises components such as a cap 98, a suction pump (not shown), a dummy jet receiver (not shown), and a cleaning mechanism (not shown). The maintenance station 99 is set so as to perform the maintenance operation of operations such as the suction recovery operation, dummy jet operation, and cleaning operation. It should be noted that the suction recovery operation is one that involves suctioning ink from the multiple nozzles 56 (see FIG. 3) of the inkjet recording head 32, whereby, for example, the elimination of bubbles within the inkjet recording head 32 is performed and the discharging qualities are recovered.

Figure 7A:
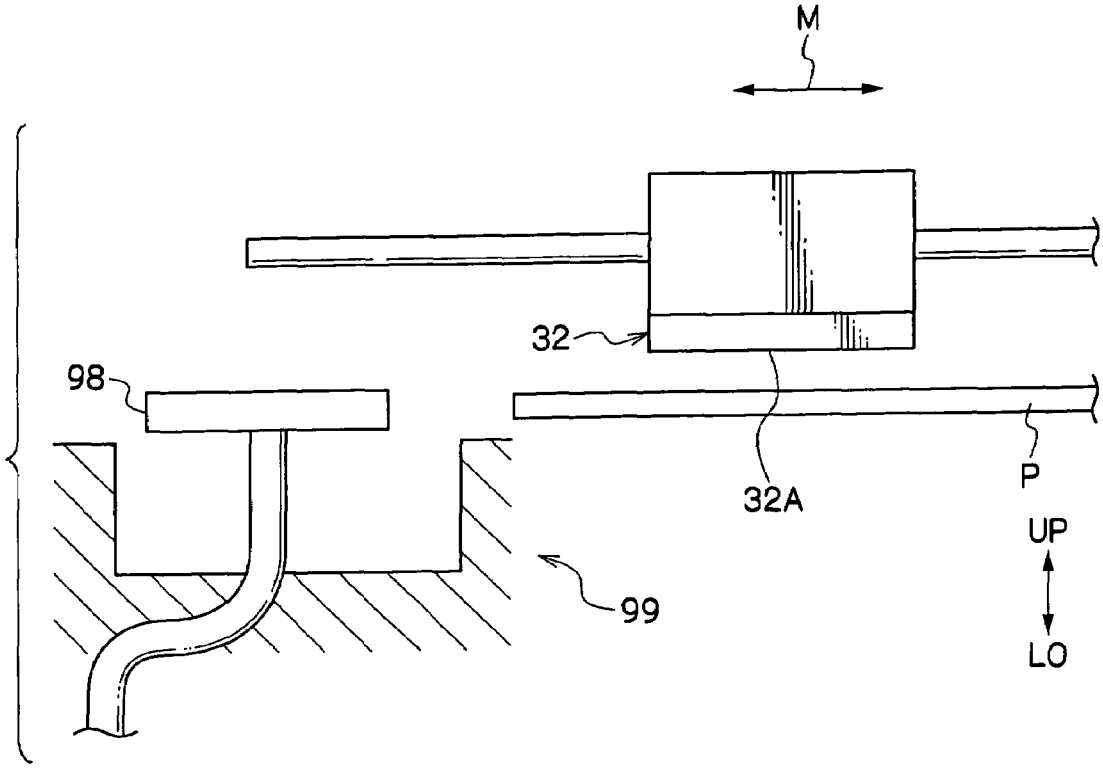
FIGS. 7A and 7B are explanatory diagrams showing a recovery operation.
Figure 7B:
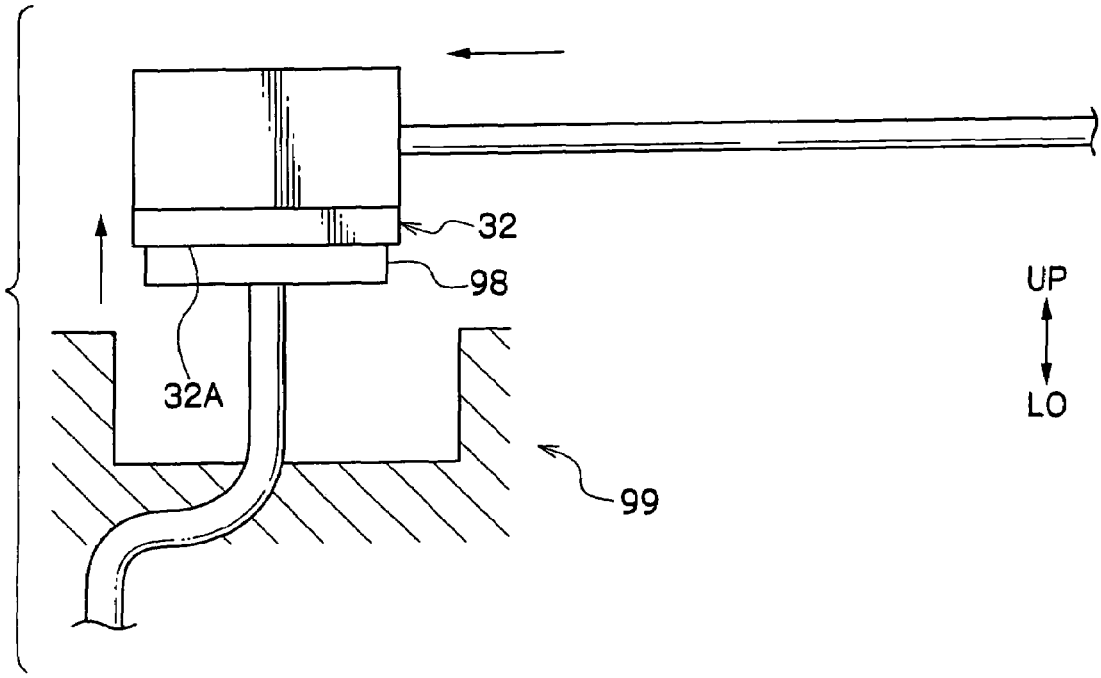

Specifically, as shown in FIGS. 7A and 7B, the ink-discharging surfaces 32A of the inkjet recording heads 32 conveyed to the top of the cap 98 of the maintenance station 99 are made to closely contact the cap 98 with an elevating mechanism (not shown). Ink is suctioned from the nozzles 56 with a suction pump (not shown), and recovery of discharging qualities is performed.

The ink suctioned from the nozzles 56 is sent to an ink disposal tank and collected there, and the ink collected in the ink disposal tank is not reused.

Next, detailed explanations will be given regarding the inkjet recording head 32.

Figure 3:
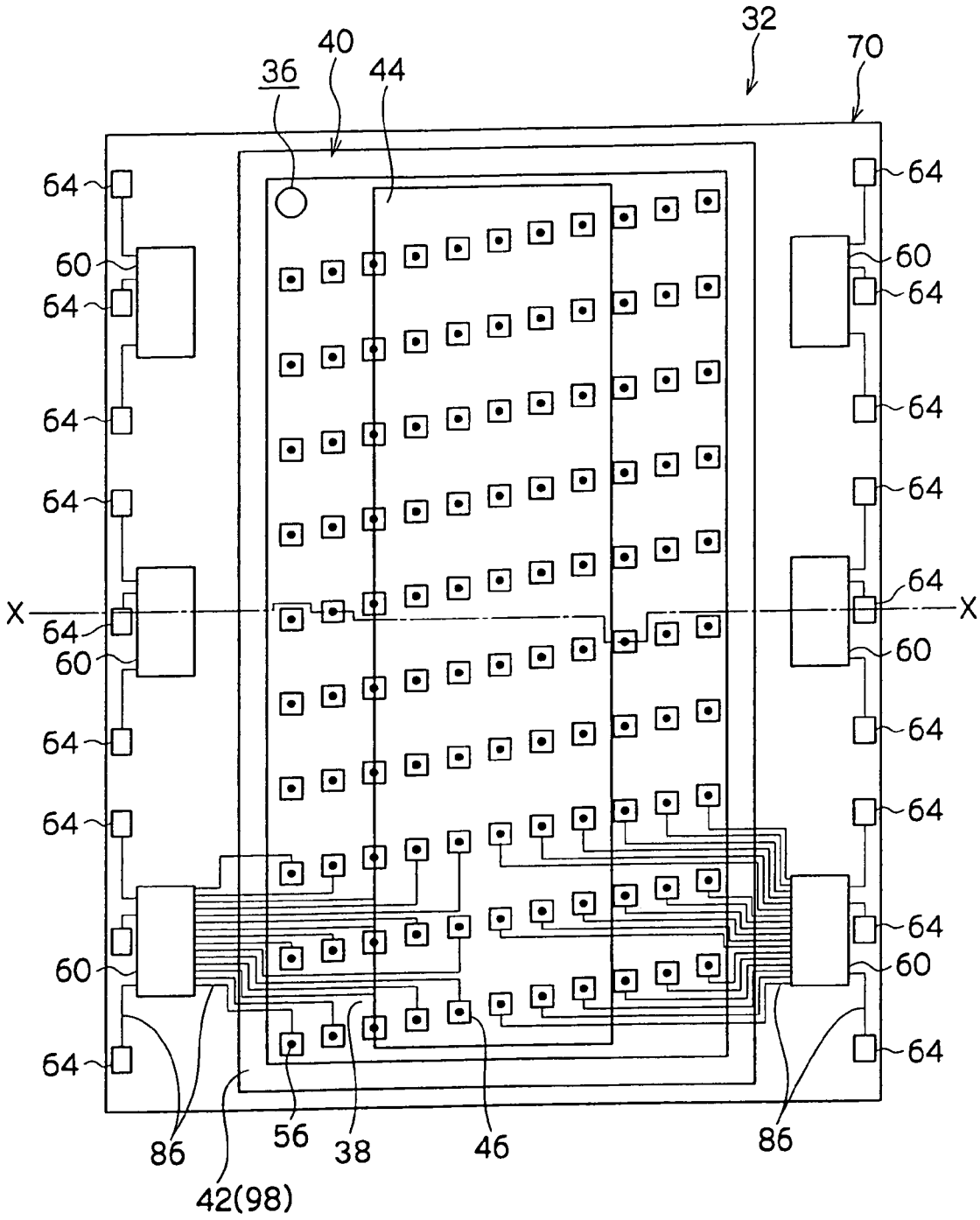
FIG. 3 is a schematic planar drawing showing the configuration of an inkjet recording head.
Figure 4:
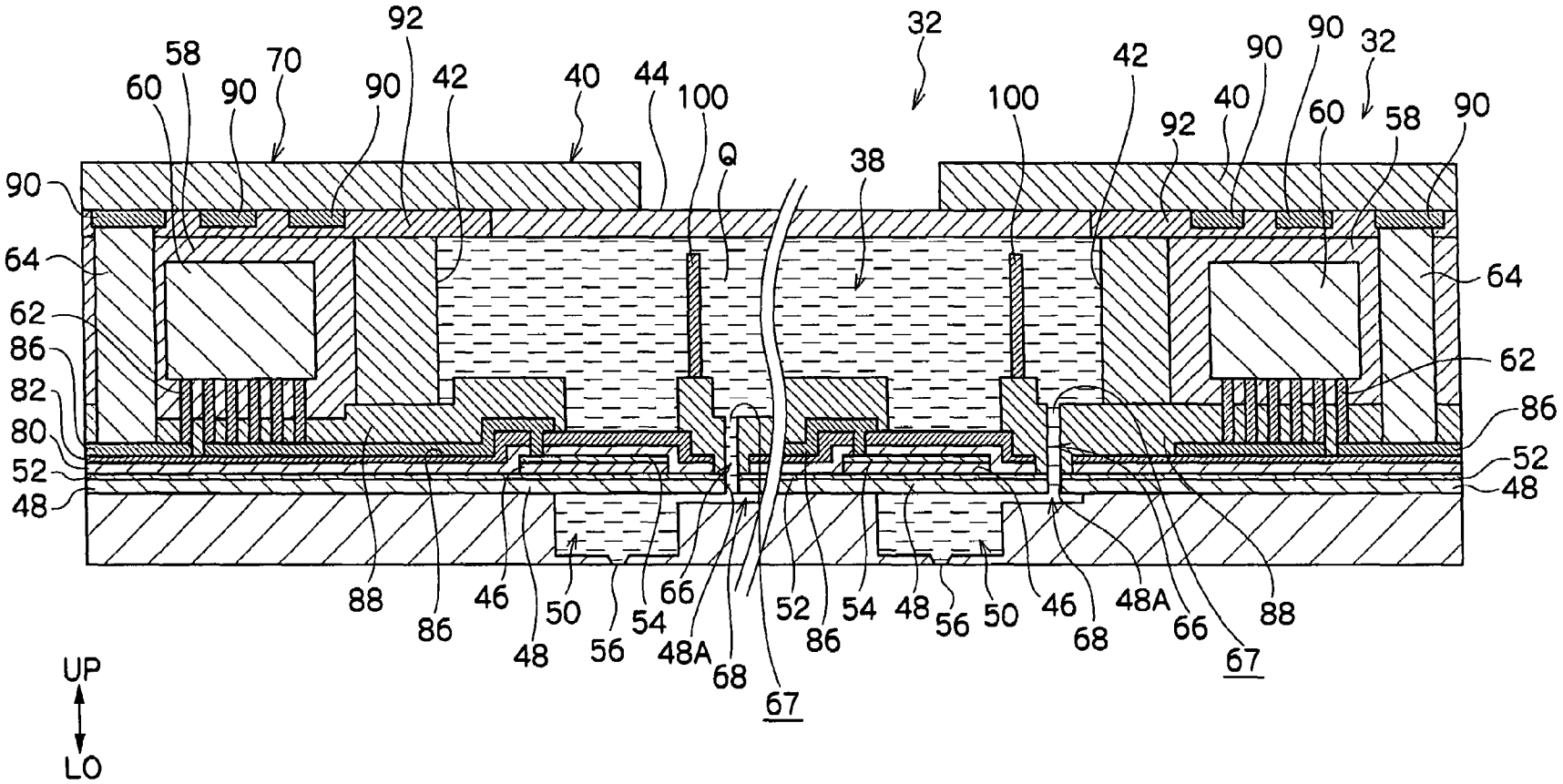
FIG. 4 is a schematic cross-sectional drawing of the X-X line of FIG. 3.

FIG. 3 is a schematic planar drawing showing the configuration of the inkjet recording head 32, and FIG. 4 is a schematic cross-sectional drawing of the X-X line of FIG. 3. As shown in these FIGS. 3 and 4, an ink injection port 36 in communication with the ink tank 34 (see FIG. 2) is provided in the inkjet recording head 32. Ink Q injected from this ink injection port 36 is accumulated in a substantially box-shaped ink pool chamber 38 (see FIGS. 8 and 9) which, when viewed flatly, appears as a quadrilateral with parallel sides.

The volume of the ink pool chamber 38 is regulated by a top panel 40 and by dividing walls 42, and the ink injection port 36 is provided in the top panel 40 of the corner portion of the ink pool chamber 38.

Further, the top panel 40 comprises the top surface of the ink pool chamber 38, and is equipped with a resin film air damper 44 that alleviates the pressure waves generated at the time ink droplets are discharged.

The material of the top panel 40 (with the exception of the air damper 44) can be any material such as glass, ceramic, silicon, and resin, as long as it is an insulator having the strength to act as the support of the inkjet recording head 32. Further, metal wiring 90 for carrying current to a drive IC 60 is provided at the top panel 40. This metal wiring 90 is covered and protected by a resin film 92 such that corrosion due to the ink Q is prevented.

The dividing walls 42 are formed from resin and divide off the ink pool chamber 38 into a rectangular shape. Further, a piezoelectric element 46 and a vibration plate 48, which is flex deformed by the piezoelectric element 46 in the up and down directions, are arranged in the inkjet recording head 32 and through these, the ink pool chamber 38 and a top panel 40 are arranged above and below. That is, it is configured so the piezoelectric element 46 and the vibration plate 48 are arranged between the ink pool chamber 38 and pressure chambers 50 so that the ink pool chamber 38 and pressure chamber 50 do not exist on the same horizontal plane.

Accordingly, it is possible for the pressure chambers 50 to be arranged in a state where they are made to be close to each other, and for the nozzles 56 to be densely arranged in a matrix pattern.

Moreover, due to this kind of configuration, an image can be formed in a wide band region with one movement of the carriage 12 in the main scanning direction, so the scanning finishes in a short time. In other words, high-speed printing of image forming on the entire face of the recording paper P can be achieved with less movement of the carriage 12 and in less time.

The piezoelectric elements 46 are adhered to the upper surface of the vibration plate 48, one for each pressure chamber 50. The vibration plate 48 is formed from a metal such as SUS and the like, and has elasticity in at least in the up and down directions. This is configured such that when the piezoelectric element 46 is energized (i.e., voltage is applied thereto) it flex deforms (i.e., displaces) in the up and down directions. It should be noted that even if the vibration plate 48 is made from an insulating material such as glass, this does not hinder the effect. A lower electrode 52 that becomes a polarity for one side is arranged at the undersurface of the piezoelectric elements 46, and an upper electrode 54 that becomes a polarity for the other side is arranged on the top surface of the piezoelectric elements 46. Also, the drive IC 60 is electrically connected to this upper electrode 54 with metal wiring 86.

Furthermore, the piezoelectric element 46 is covered and protected by an insulating coat with low water-permeability (hereafter, "SiOx film 80"). Since the SiOx film 80 that covers and protects the piezoelectric element 46 is coated with the condition that moisture permeation becomes lower, penetration of moisture into the interior of the piezoelectric element 46 and ruining of reliability (i.e., deterioration of piezoelectric qualities occurring due to reduction of oxygen within the PZT coat) can be prevented. Notably, the vibration plate 48 of metal (e.g., SUS, etc.) contacting the lower electrode 52 also serves to function as low-resistance GND wiring.

Further, with regard to the piezoelectric element 46, the upper surface of the SiOx film 80 is covered and protected by a resin film 82. Due to this, the piezoelectric element 46 becomes such that its resistance to corrosion by the ink Q can be ensured. Further, the metal wiring 86 is also covered and protected by a resin protective film 88 so as to be able to prevent corrosion due to the ink Q.

Moreover, the upper side of the piezoelectric element 46 is covered and protected by the resin film 82 and configured such that it is not covered by the resin protective film 88. Since the resin film 82 is a flexible resin layer, due to this configuration, displacement obstruction of the piezoelectric elements 46 (i.e., the vibration plate 48) can be prevented (such that it can favorably flex deform in the up and down directions). In other words, when the resin layer on the piezoelectric element 46 is thin, the effect of suppressing displacement obstruction improves, so this is made so as to not be covered by the resin protective film 88.

Since the resin protective film 88 is formed from a resin material that is the same as the resin film 82 laminated over the metal wiring 86, the joining strength of these covering the metal wiring 86 becomes strong, so corrosion of the metal wiring 86 due to penetration of ink 110 from the interfaces can be prevented.

Further, the resin protective film 88 and the resin film 82 that cover the metal wiring 86 so as to sandwich it are made from the same type of resin material, so their coefficients of thermal expansion are substantially equal. Accordingly, there is little generation of heat stress.

Furthermore, this resin protective film 88 is made from the same type of resin material that the dividing wall 42 is also made from, so the joining strength with the dividing wall 42 is strong. Accordingly, this is configured so there is better protection against penetration of the ink 110 from the interfaces. Further, by configuring these components in this manner with the same type of resin material, their coefficients of thermal expansion are substantially equal so similarly, there is little generation of heat stress.

The drive IC 60 is mounted underneath the piezoelectric element substrate 70, arranged between the top panel 40 and vibration plate 48 at the exterior side of the ink pool chamber 38 regulated by the dividing wall 42, and configured so as to not be exposed (i.e., to not protrude) from the vibration plate 48 and top panel 40. Accordingly, the inkjet recording head 32 can be made to be more compact.

It should be noted that the vibration plate 46 urges up towards the entire substrate of the piezoelectric element substrate 70, and the top panel 40 becomes a supporting body.

Figure 5:
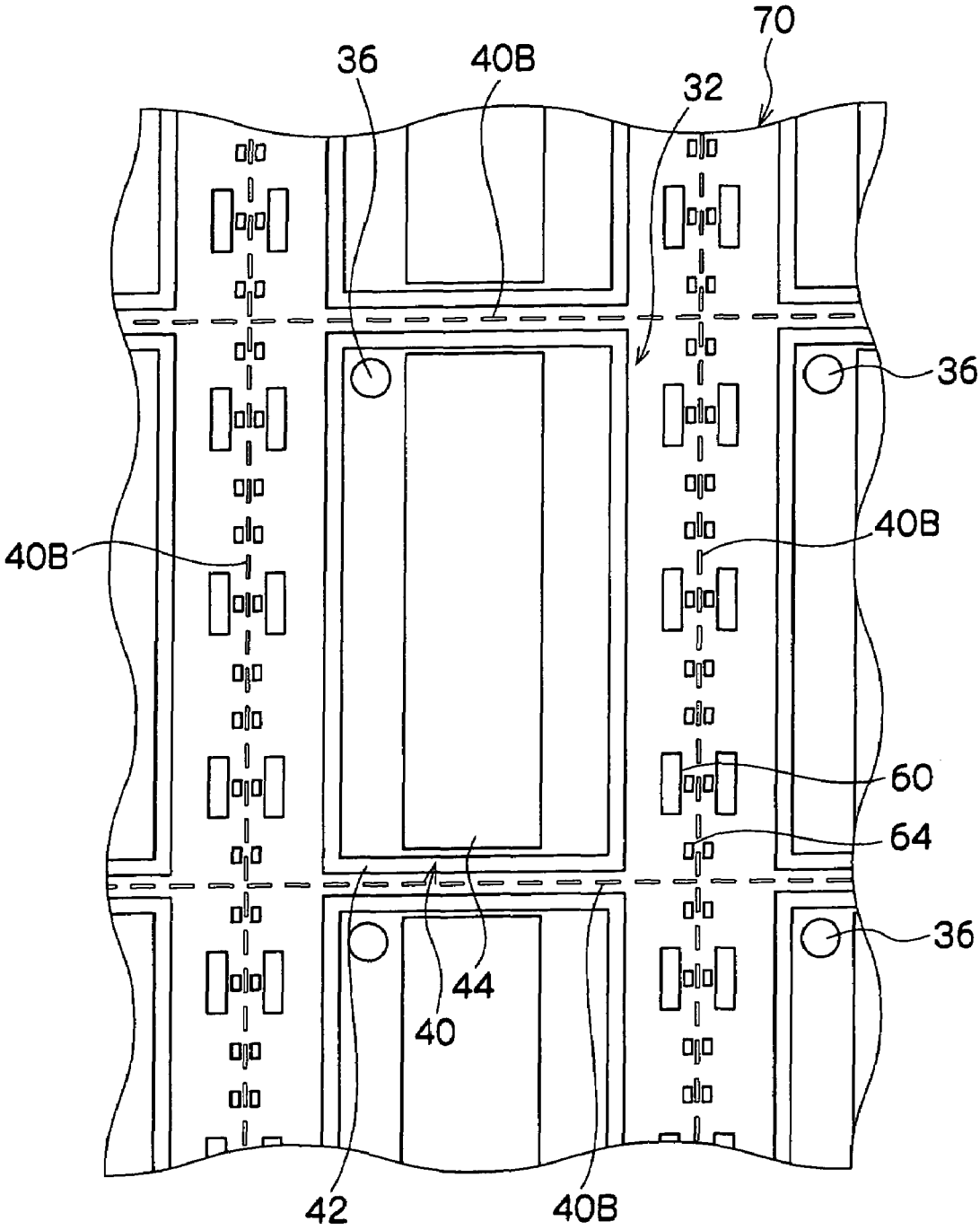
FIG. 5 is schematic planar drawing showing a top panel prior to cutting as the inkjet recording head.

Further, the periphery of the drive IC 60 is sealed with a resin material 58. As shown in FIG. 5, multiple fill holes 40B of the resin material 58 that seals the drive IC 60 are provided, in a lattice formation in the top panel 40 at the manufacturing stage, so as to divide off each inkjet recording head 32. After joining (i.e., connecting) the piezoelectric element substrate 70 and the pressure chamber 50 and the like to the formed channel substrate, the top panel 40 is cut along the fill holes 40B sealed (i.e., blocked) by the resin material 58, whereby multiple inkjet recording heads 32 having the matrix-patterned nozzles 56 (see FIG. 3) are configured to be manufactured at one time.

Figure 6:
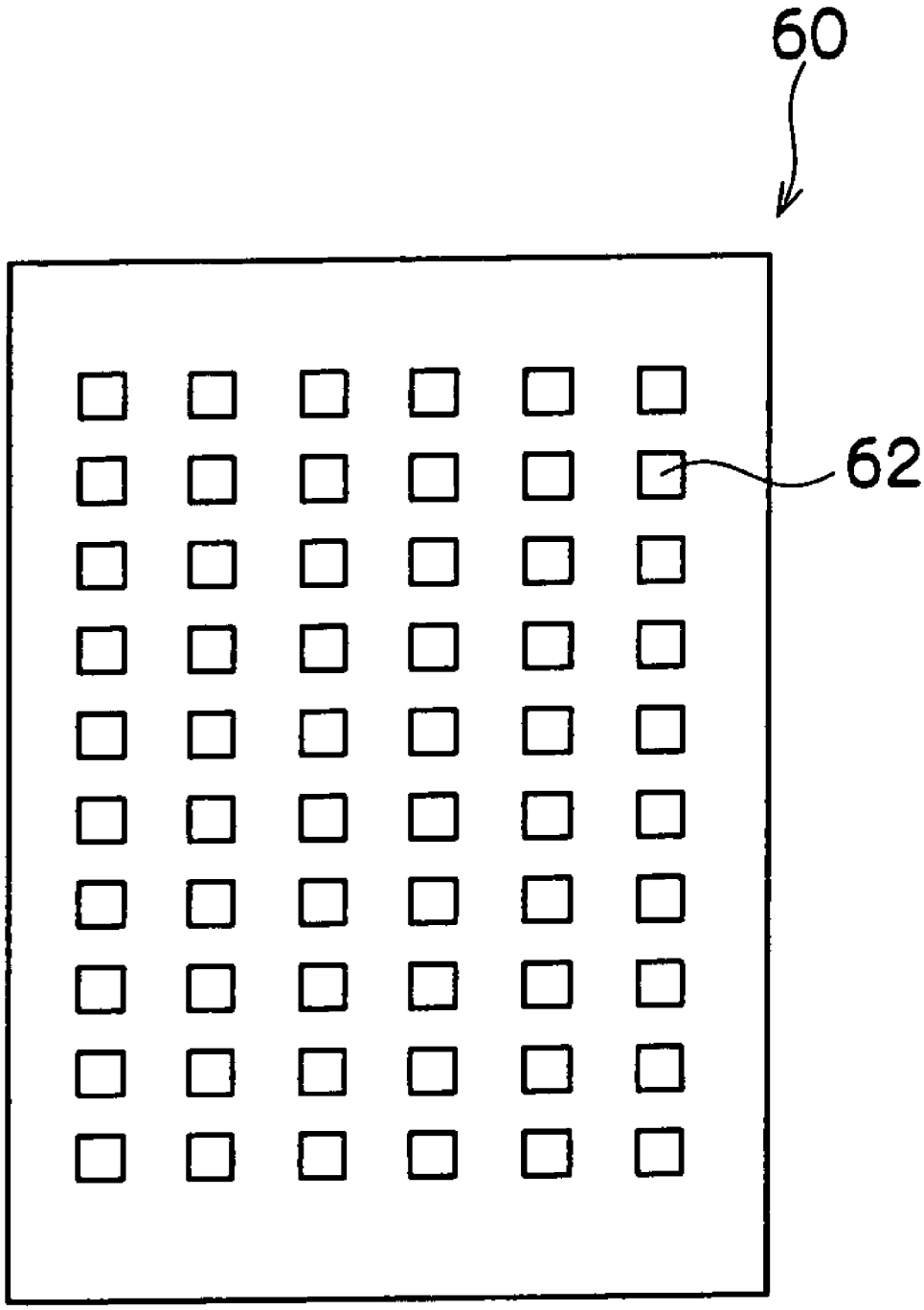
FIG. 6 is schematic planar drawing showing the bumps of a drive IC.

Furthermore, as shown in FIGS. 4 and 6, multiple bumps 62 are provided at the undersurfaces of this drive IC 60 in a matrix pattern so as to protrude at a preset height. Flip chips are mounted (i.e., surface mounted) on the metal wiring 86 of the piezoelectric element substrate 70 formed on the piezoelectric element 46 on the vibration plate 48. Accordingly, it is easy to realize high-density connectivity relative to the piezoelectric element 46, and reduction of the height of the drive IC 60 can be achieved (i.e., it can be made to be thin). The inkjet recording head 32 can thus be made to be compact due to this feature as well.

Further, in FIG. 3, bumps 64 are provided on the outer sides of the drives IC 60. These bumps 64 are connected to the metal wiring 90 provided on the top panel 40 (see FIG. 4) and the metal wiring 86 provided on the piezoelectric element substrate 70, and these are of course provided such that they are taller than the height of the drives IC 60 surface mounted on the piezoelectric element substrate 70.

Accordingly, this is a configuration where current is run to the metal wiring 90 of the top panel 40 from the main body side of the inkjet recording device 10 (see FIG. 1), current is run to the metal wiring 86 through the bumps 64 from the metal wiring 90 of the top panel 40, and current is run from there to the drive IC 60. Then voltage is applied to the piezoelectric element 46 at preset timing with the drive IC 60, and the ink Q filled in the pressure chamber 50 is pressurized and ink droplets are discharged due to the vibration plate 48 flex deforming in the up and down directions.

The nozzles 56 that discharge the ink droplets are provided at preset positions at one per pressure chamber 50. The pressure chamber 50 and the ink pool chamber 38 are in contact due to the communication between the ink supply path 66 linked to the through hole 48A provided at the vibration plate 48 and the ink supply path 68 provided so as to extend from the pressure chamber 50 in the horizontal direction (see FIG. 4) while avoiding the piezoelectric element 46. This ink supply path 68 is provided so as to be slightly longer than the portion connecting to the ink supply path 66, which is actually provided in advance, so that alignment is possible with the ink supply path 66 (i.e., so as to be connected thereto with certainty) at the time the inkjet recording head 32 is manufactured.

Next, explanations will be given regarding the first embodiment of the ink pool chamber 38.

Figure 9:
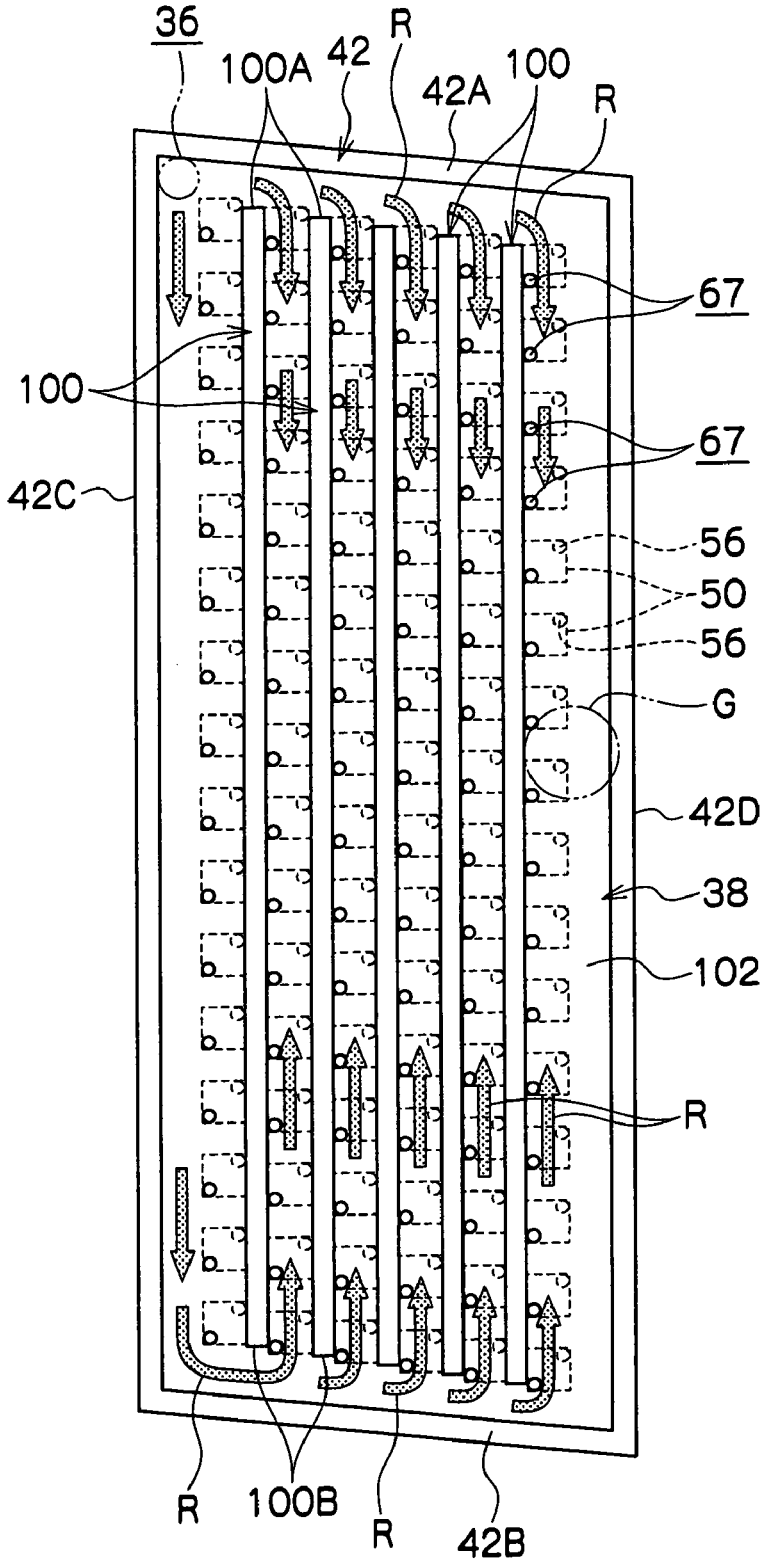
FIG. 9 is a planar drawing that shows the pattern of the ink pool chamber of the first embodiment and explains the ink flow thereof.

As shown in FIG. 9, supply openings 67 of the ink supply path 66 are formed to line in a matrix pattern on an undersurface 102 of the ink pool chamber 38. For the sake of convenience of explanation, the lines of the supply openings 67 in the longitudinal direction (i.e., up-down directions) will be referred to as "rows", and the lines in the perpendicular direction (i.e., the left-right directions) as "lines".

It should be noted that in the subsequent drawings of the ink pool chamber, it appears that the pressure chamber 50 and the supply openings 67 overlap, however, as seen in FIG. 4, these do not in fact overlap. Nonetheless, this does not have any particular relation to the operational effect of the present invention, and these are shown in this manner in order to avoid making the drawings complicated and difficult to understand.

As shown in FIG. 9, current plates 100 are provided along each row of supply openings 67 between each row of supply openings 67. Further, both the end parts 100A and other end parts 100B of the current plates 100 do not connect with a side wall 42A and side wall 42B of the ink pool chamber 38. Rather, gaps are formed between the end parts 100A/100B and the side walls 42A/42B.

Figure 8:
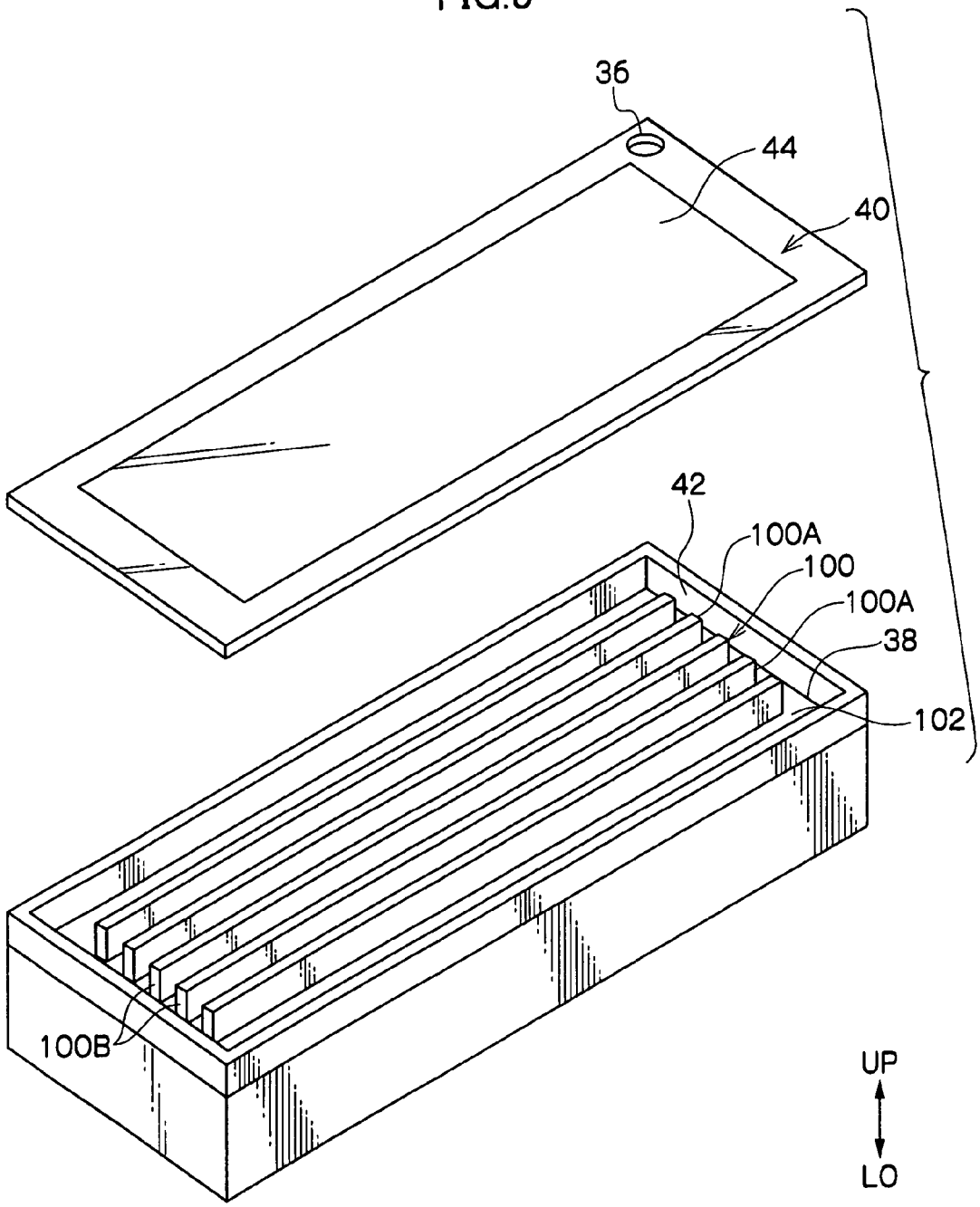
FIG. 8 is an exploded perspective drawing showing the pattern of the ink pool chamber of the first embodiment.

As shown in FIG. 8, the current plates 100 are provided so as to stand up from the undersurface 102, and as shown in FIG. 4, gaps are also formed between the current plates 100 and the air damper 44. Accordingly, these do not interfere with the damper effect of the air damper 44 (i.e., the effect of alleviating pressure waves when ink droplets are discharged).

The current plates 100 were arranged in this way in the ink pool chamber 38, so the ink Q injected from the ink injection port 36 flows along the ink channels formed by the current plates 100 and is sent to the pressure chamber 50 from each supply opening 67 via the ink supply path 66 (see the R arrow in FIG. 9).

Further, these current plates 100 are made from a material having less rigidity than the material of the undersurface 102 of the ink pool chamber 38. For this reason, the current plates 100 also exhibit a damper effect. In the present embodiment, these are made from the same material as that of the air damper 44 (see FIG. 8).

Accordingly, the acoustic capacity of the ink pool chamber 38 is sufficiently ensured due to the damper effects of both the air damper 44 and the current plates 100, and cross talk is sufficiently suppressed.

It should be noted that it is not necessary to make the current plates 100 function as strengthening components for the inkjet recording head 32. For this reason, even if the material of the current plates 100 is made to have low rigidity and to exhibit a damper effect, problems do not occur.

Next, the operation of the present embodiment will be explained.

Immediately after making the inkjet recording head 32, ink is not filled therein, so a jig is used for suction from the nozzles 56 (see FIG. 3) and an ink filling operation where ink is filled is performed.

Further, as previously described, the cap 98 is made to closely contact the ink-discharging surface 32A of the inkjet recording head 32 at preset timing, and suction of ink from the nozzles 56 and a recovery operation are performed.

Hereafter, there are cases where the ink filling operation and recovery operation are referred to as "ink suction operation".

With this kind of ink suction operation, ink is injected into the ink pool chamber 38 from the ink injection port 36. Then, as shown in FIG. 9, the ink injected from the ink injection port 36 flows along the ink channels formed by the current plates 100 and is sent to the pressure chamber 50 via the ink supply path 66 from each supply opening 67.

Figure 18:
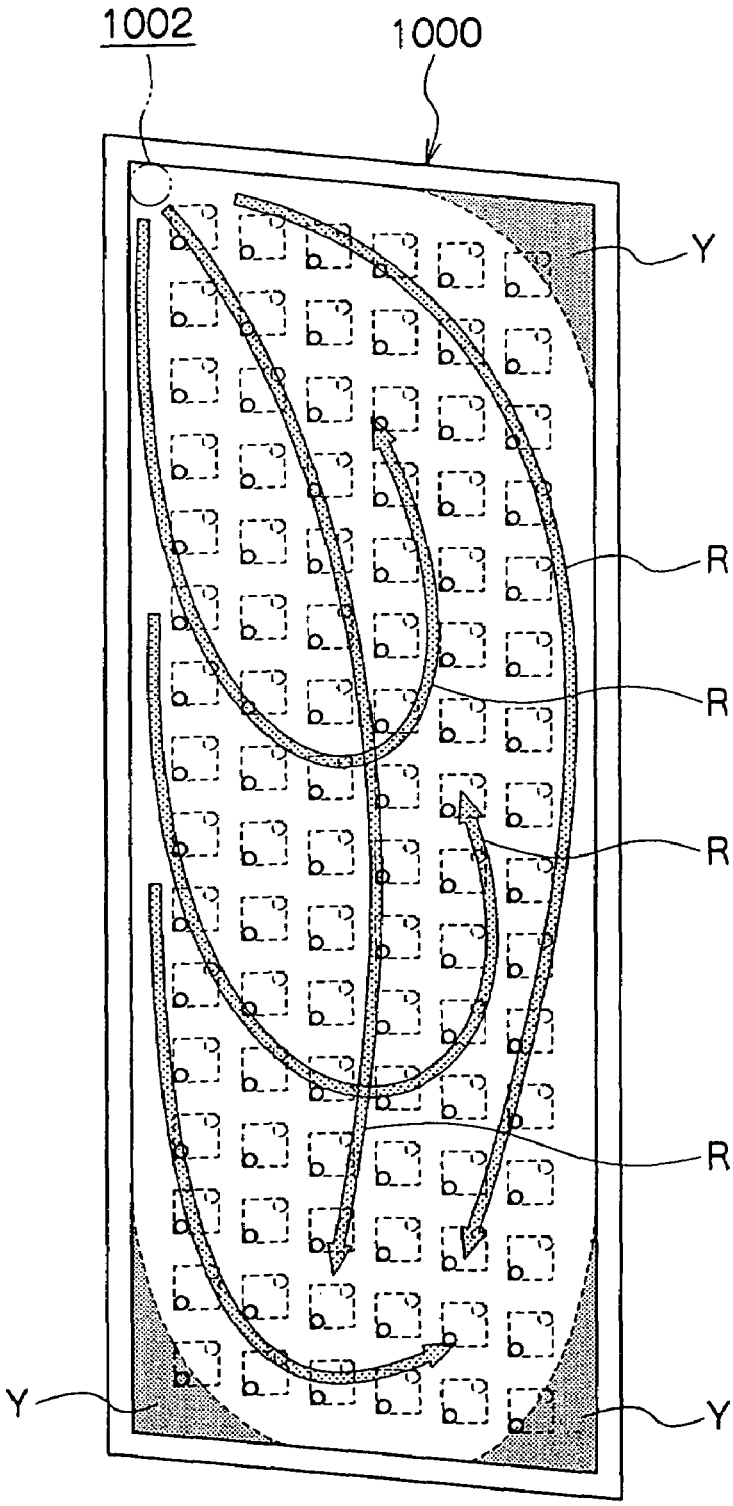
FIG.18 RELATED ART
FIG. 18 is a planar drawing that shows the pattern of a conventional ink pool chamber and explains the situation where disorderly flow of ink and stagnation occurs.

Due to this, the ink of the ink pool chamber 38 does not flow in a disorderly manner and a stagnant portion Y is not generated (refer to FIG. 18).

Accordingly, with the inkjet recording head 32 of the present embodiment, bubbles are smoothly suctioned with the ink from the nozzles 56 and eliminated. Due to this, the ink suction operation is completed in a short amount of time.

That is, ink is not wastefully consumed and also, the ink filling operation can be efficiently performed or the recovery operation completed in short time.

Figure 10:
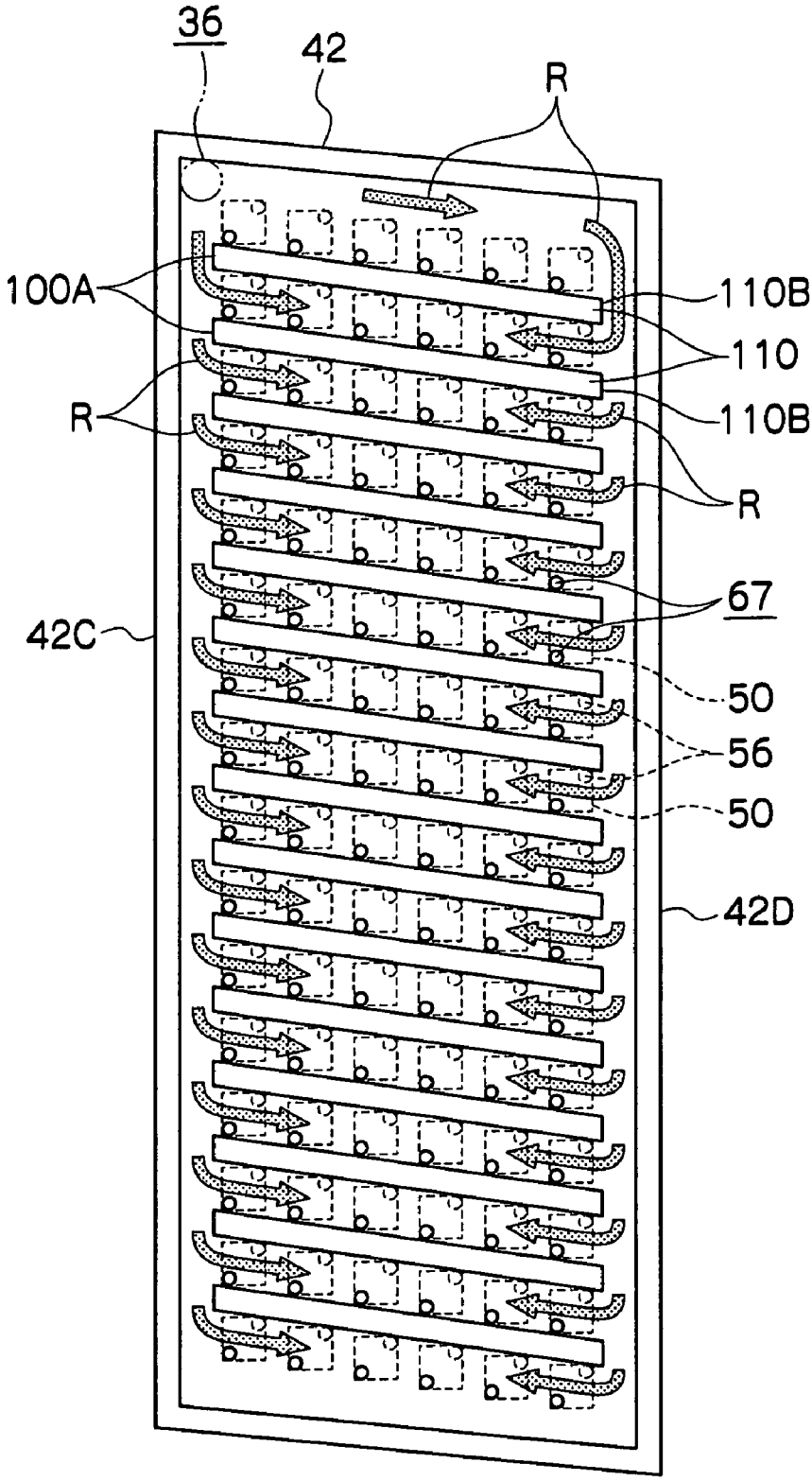
FIG. 10 is a planar drawing that shows the pattern of an alternate example of the ink pool chamber of the first embodiment and explains the ink flow thereof.

As seen in the alternate example of the ink pool chamber 38 of the first embodiment shown in FIG. 10, the current plates are arranged between each of the lines of supply openings 67, along each of the lines of supply openings 67.

Next, explanations will be made regarding the ink pool chamber 238 of the second embodiment.

Figure 11:
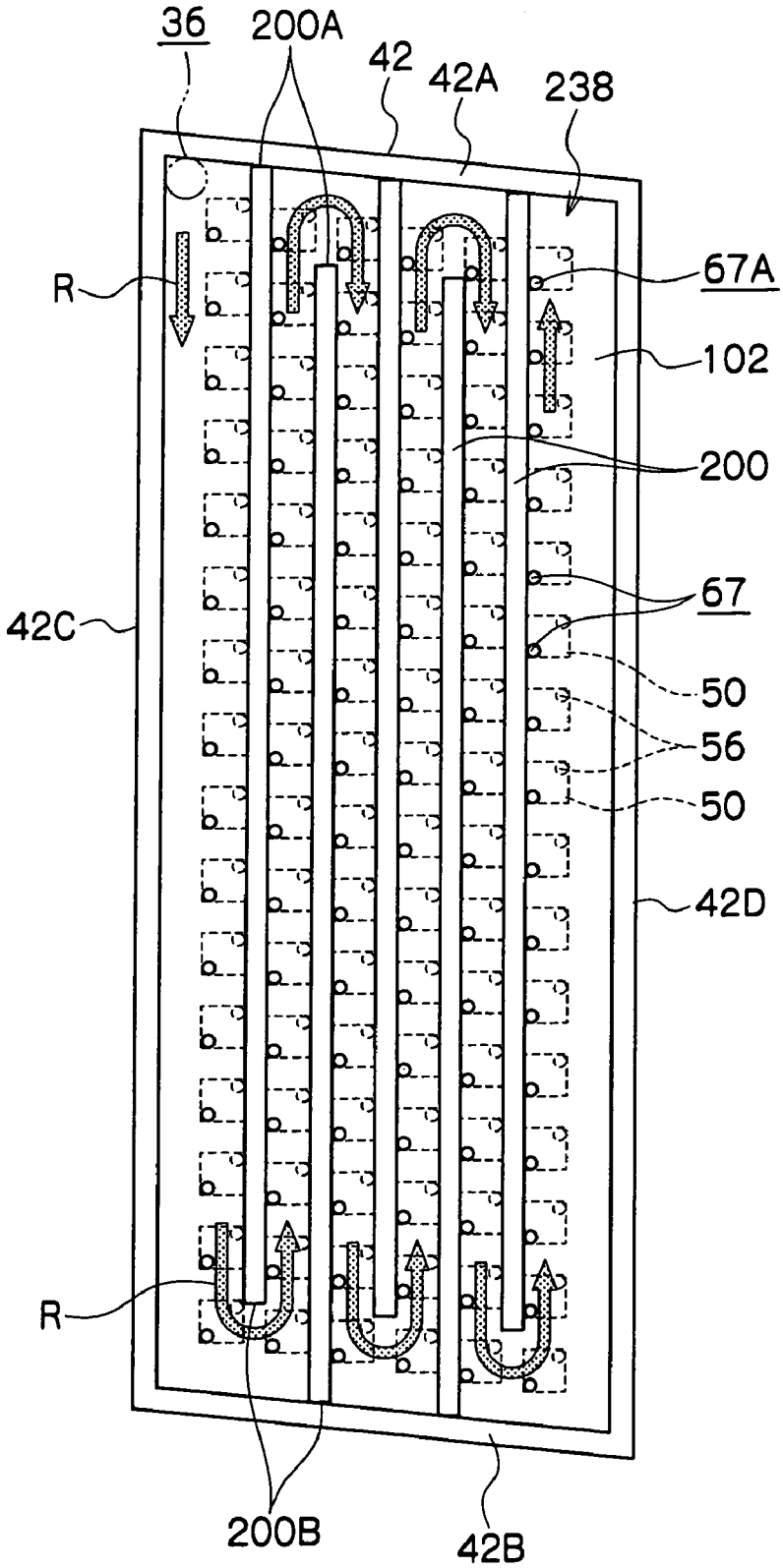
FIG. 11 is a planar drawing that shows the pattern of the ink pool chamber of the second embodiment and explains the ink flow thereof.

As shown in FIG. 11, current plates 200 are arranged between each row of supply openings 67, along the rows of supply openings 67. One end part 200A and another end part 200B of the current plates 200 are alternately joined to the opposite side wall 42A and side wall 42B. Further, those end parts 200A or 200B not joined thereto have gaps opened between the side wall 42A or side wall 42B. Due to this, as indicated with the R arrow, ink injected from the ink injection port 36 flows one way to a supply opening 67A at the end of the ink channel formed by the current plates 200.

Next, the operation of the present embodiment will be explained.

As shown in FIG. 9, the flow of the ink collides at the G portion in the ink pool chamber 38 of the first embodiment. It is easy for bubbles to accumulate when ink collides at the G portion in this manner.

In contrast, with the ink pool chamber 238 of the second embodiment shown in FIG. 11, the ink injected from the ink injection port 36 flows one way to the supply opening 67A at the end of the ink channel formed by the current plates 200 so there is no spot where the flow of the ink collides. Due to this, bubbles are discharged more smoothly.

Figure 12:
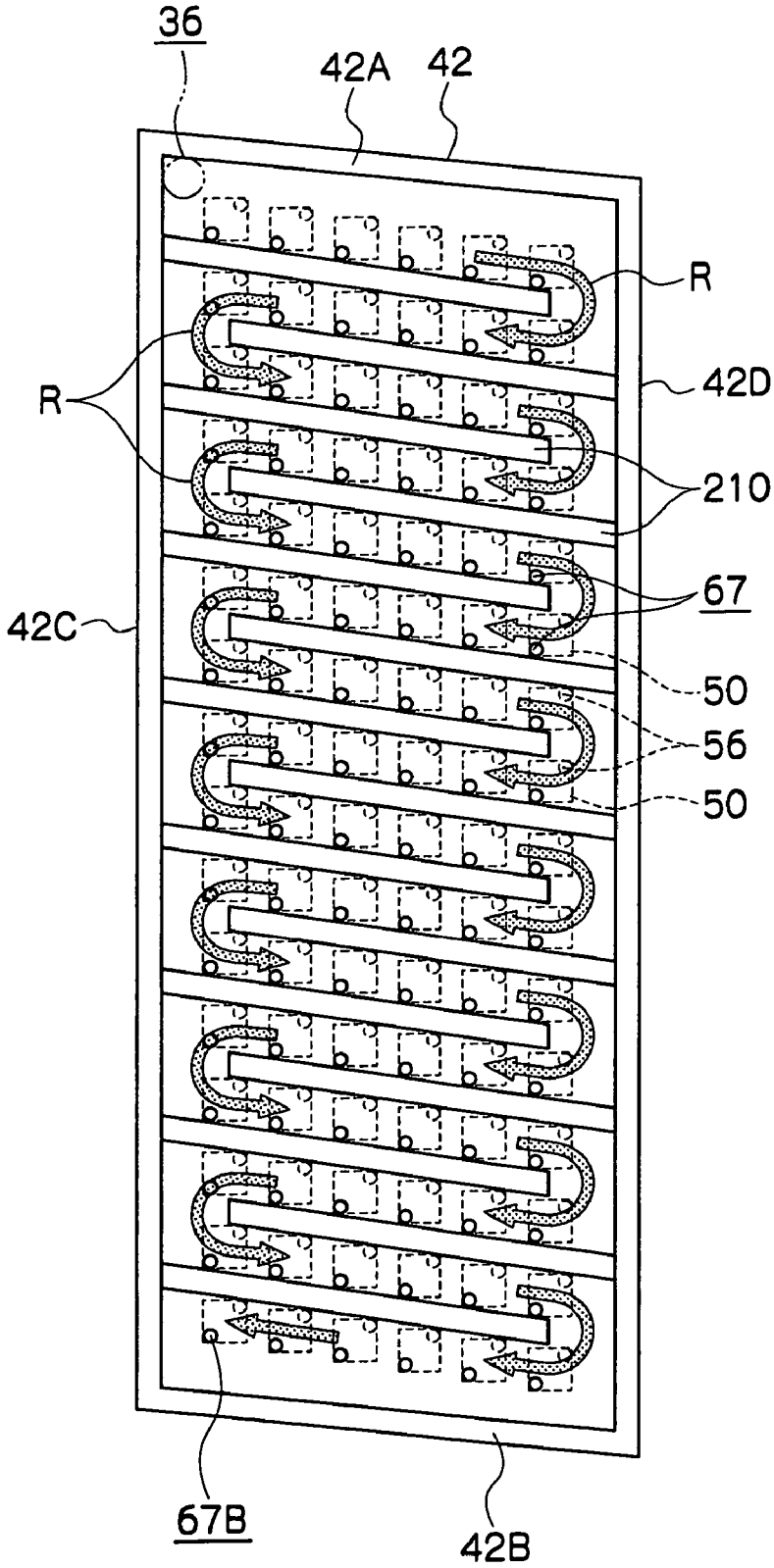
FIG. 12 is a planar drawing that shows the pattern of an alternate example of the ink pool chamber of the second embodiment and explains the ink flow thereof.

As seen in the alternate example of the ink pool chamber 238 of the second embodiment shown in FIG. 12, the current plates 210 are arranged between each of the lines of supply openings 67 along each of the lines of supply openings 67, and these can be alternately joined with an opposite side wall 42C and side wall 42D. When thus configured, ink flows one way to a supply opening 67B at the end of the ink channel formed by the current plates 210, as indicated with the R arrows.

Next, explanations will be made regarding the ink pool chamber 338 of the third embodiment.

Figure 13:
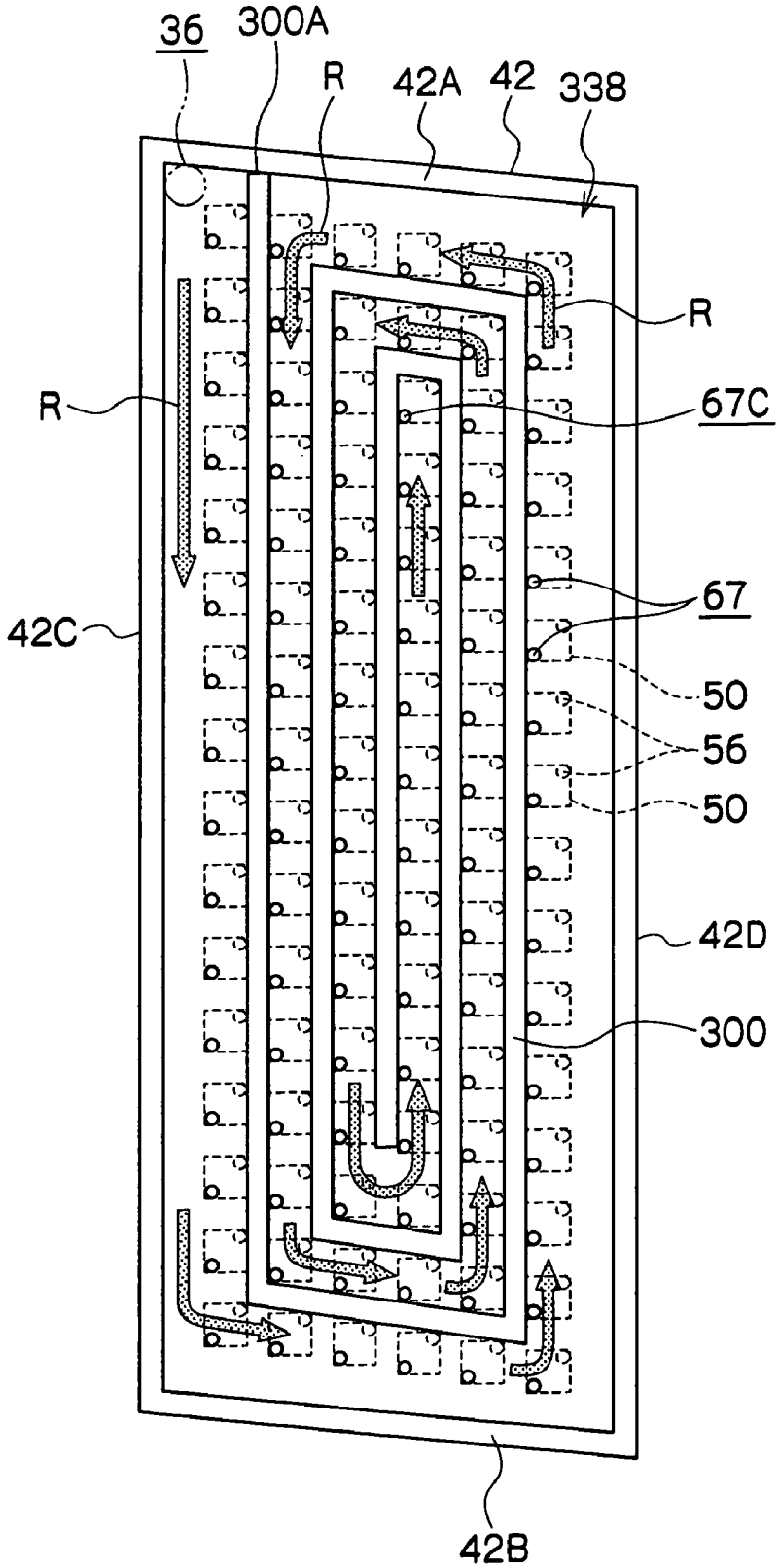
FIG. 13 is a planar drawing that shows the pattern of the ink pool chamber of the third embodiment and explains the ink flow thereof.

As shown in FIG. 13, a current plate 300 is arranged in a whirlpool pattern along the supply openings 67, and an end part 300A is joined to the side wall 42A. Due to this, as indicated with the R arrows, ink injected from the ink injection port 36 flows one way to a supply opening 67C at the end of the ink channel formed by the current plates 300.

It should be noted that an operation similar to that of the second embodiment is achieved with the present embodiment.

Next, explanations will be made regarding the ink pool chamber 438 of the fourth embodiment.

Figure 14:
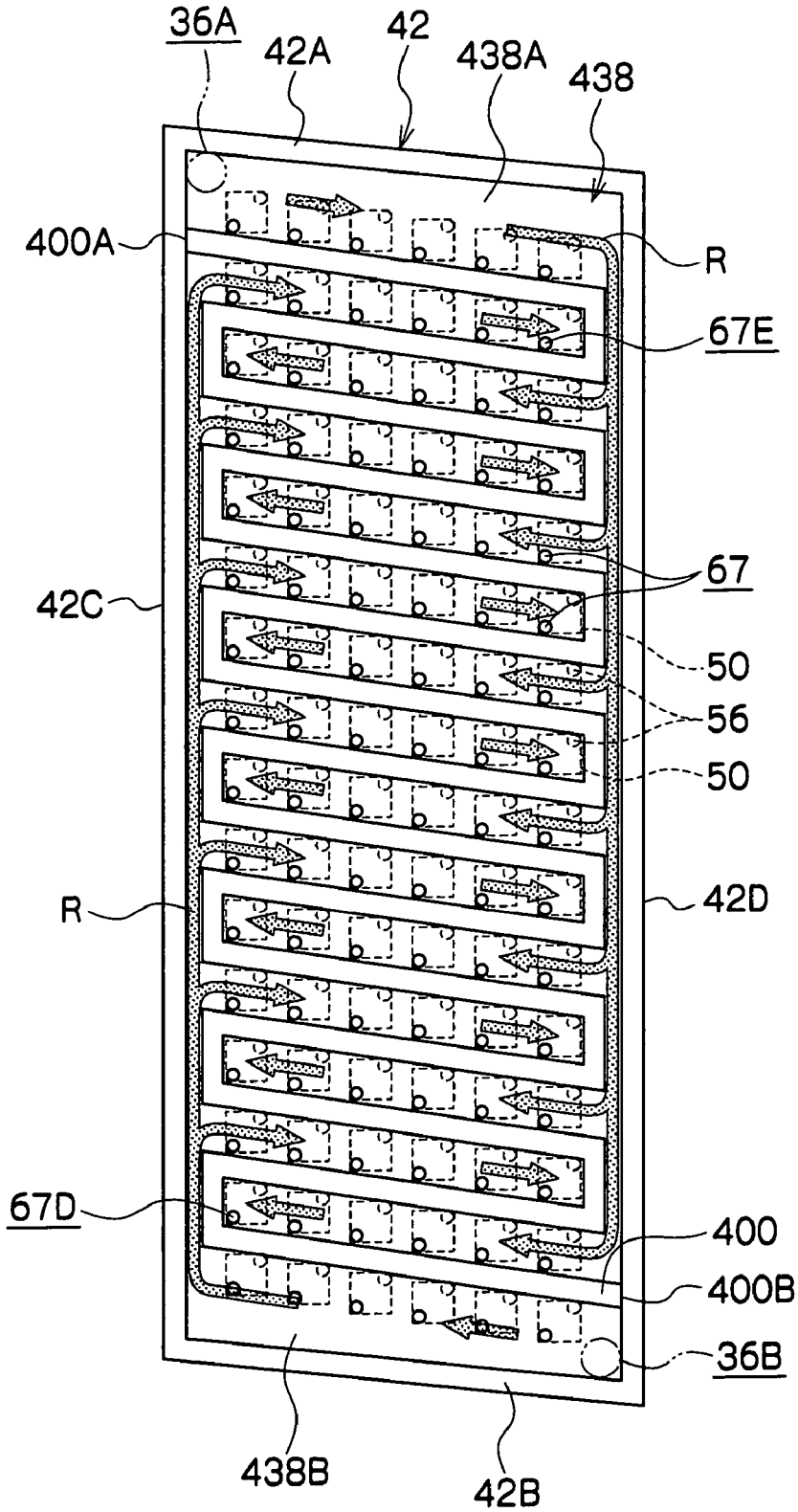
FIG. 14 is a planar drawing that shows the pattern of the ink pool chamber of the fourth embodiment and explains the ink flow thereof.

As shown in FIG. 14, a current plate 400 is arranged to meander along the supply openings 67, and an end part 400A is joined to the side wall 42C and another end part 400B is joined to a side wall 42D.

Due to this, the ink pool chamber 438 is divided into two regions, an ink pool chamber 438A and an ink pool chamber 438B, by the current plate 400. Further, an ink injection port 36A and ink injection port 36B are provided in the respective corner portions of the ink pool chamber 438A and ink pool chamber 438B.

Accordingly, as indicated with the R arrows, ink injected from the ink injection port 36A flows one way to the supply opening 67D at the end of the ink pool chamber 438A formed by the current plate 400. Similarly, ink injected from the ink injection port 36B flows one way to the supply opening 67E at the end of the ink pool chamber 438B formed by the current plate 400.

Next, explanations will be made regarding the operation of the present embodiment.

The configuration shown in FIG. 11 will be used as an example. In this case, the distance from the ink injection port 36 to the supply opening 67A at the end is long. Due to this, the channel resistance from the ink injection port 36 increases, especially the closer the ink proceeds to the end, so the flow speed of the ink decreases. For this reason, there are cases where bubbles are not smoothly eliminated. Further, in comparison between the ink injection port 36 vicinity and the vicinity at the end, a large difference in flow resistance is generated. Due to this, there are cases where differences arise in the discharging characteristics of the ink droplets and in the refill time after discharging, because of the nozzles 56 linked to the supply openings 67 of the ink injection port 36 vicinity and to the nozzles 56 linked to the supply openings 67 at the vicinity of the end.

In contrast, the ink pool chamber 438 of the present embodiment is divided by the current plate 400 into two regions, an ink pool chamber 438A and an ink pool chamber 438B. Due to this, the ink channels of the ink pool chamber 438A and ink pool chamber 438B are short. That is, the flow resistance at the ink pool chamber 438A and the ink pool chamber 438B is small so ink flows smoothly and bubbles are smoothly purged from the supply openings 67D and supply openings 67E. Further, differences in the discharging characteristics of the ink droplets and in the refill time after discharging lessen.

Further, when the channel resistance is great, it is usually necessary to increase the suction pressure of the ink suction operation in order to generate the flow speed necessary for eliminating the bubbles, however, as previously described, since the channel resistance is small, the suction pressure of the ink suction operation can be made to be small.

It should be noted that the present invention is not limited to the above-described embodiments.

For example, with the present embodiment, the ink pool chamber 38 was made to be, when viewed flat, a substantially box-shaped parallelogram, however, it is not limited to this shape only. For example, when viewed flat, this can be made to appear as a triangle or quadrangle, or a polygon with five or more sides, or made to have a cylindrical shape.

Figure 15:
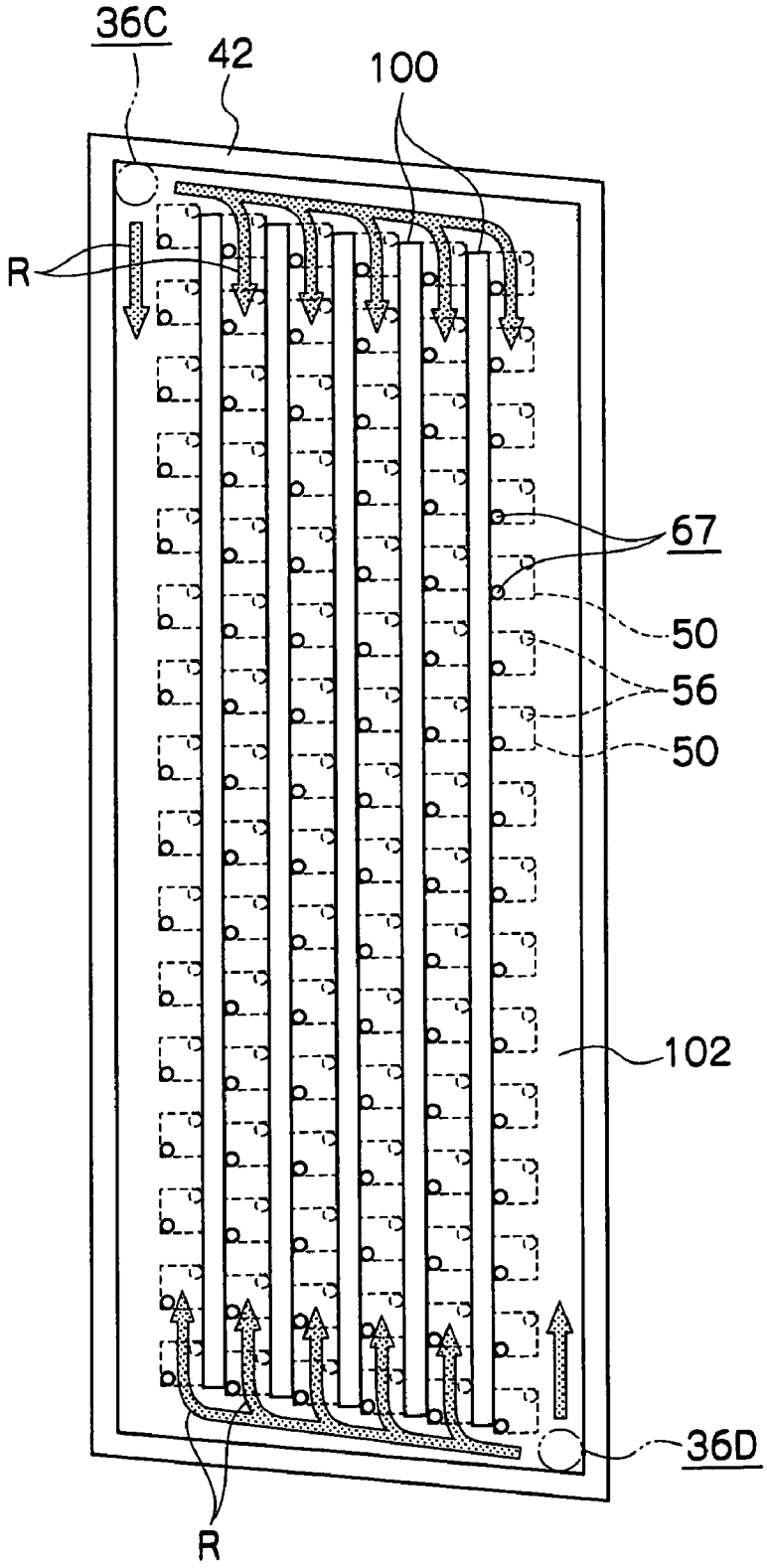
FIG. 15 is a planar drawing that shows the pattern of another ink pool chamber and explains the ink flow thereof.

Moreover, with the present embodiment, there was, for example, one ink injection port 36 but multiple ink injection ports 36 can also be arranged. As can be seen in the example in FIG. 15, two ink injection ports 36 of an injection port 36C and injection port 36D can be arranged, and although not shown, three or more ink injection ports 36 can also be provided.

Further, although not shown in the drawings, it is possible for the ink injection ports 36 to be provided in the top panel 40, i.e., in areas other than the corner parts of the ink pool chamber 38. These can also be randomly provided in another place such as the central portion. The ink injection ports 36 can also be provided in a place besides the top panel 40, such as the dividing wall 42.

Figure 16:
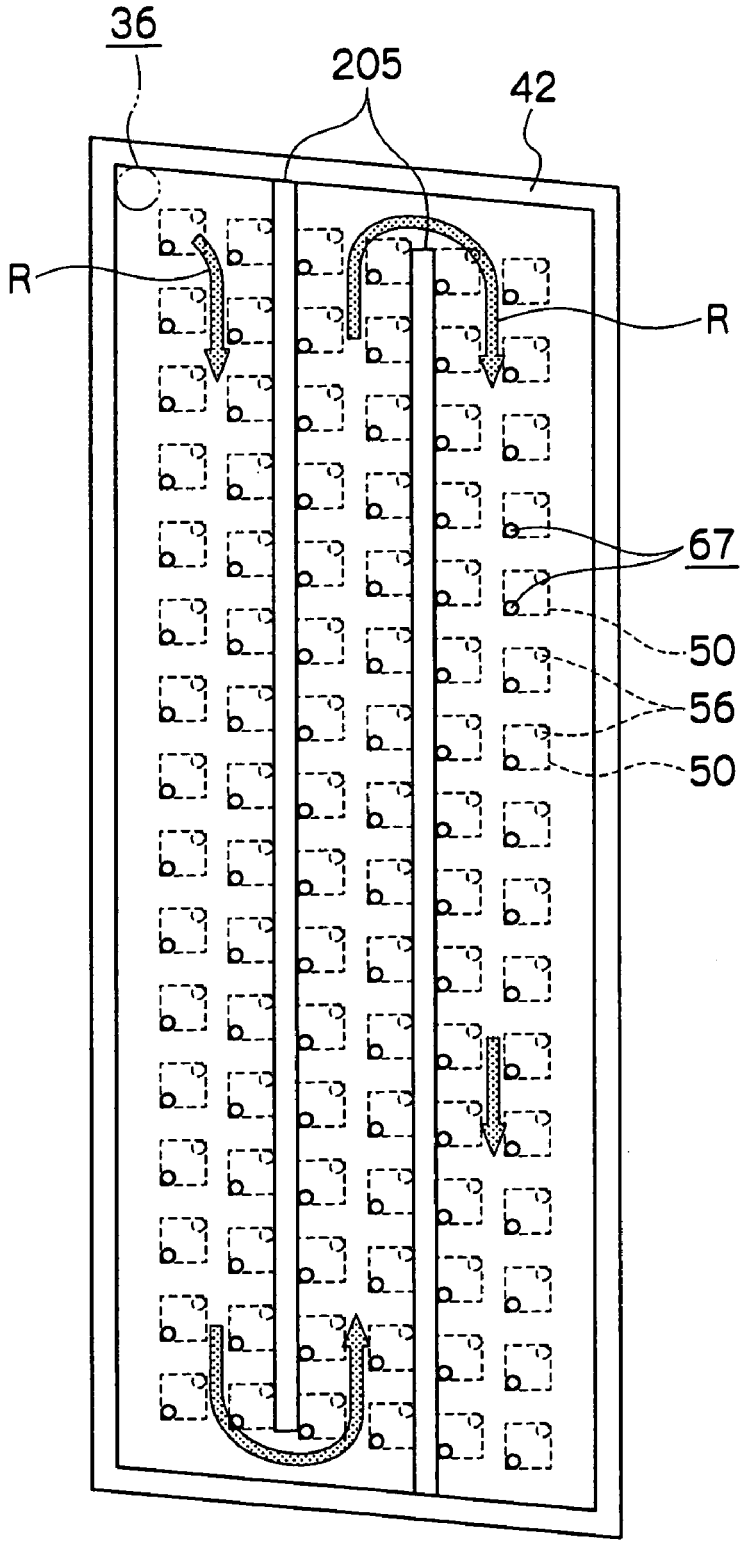
FIG. 16 is a planar drawing that shows the pattern of another ink pool chamber and explains the ink flow thereof.
Figure 17:
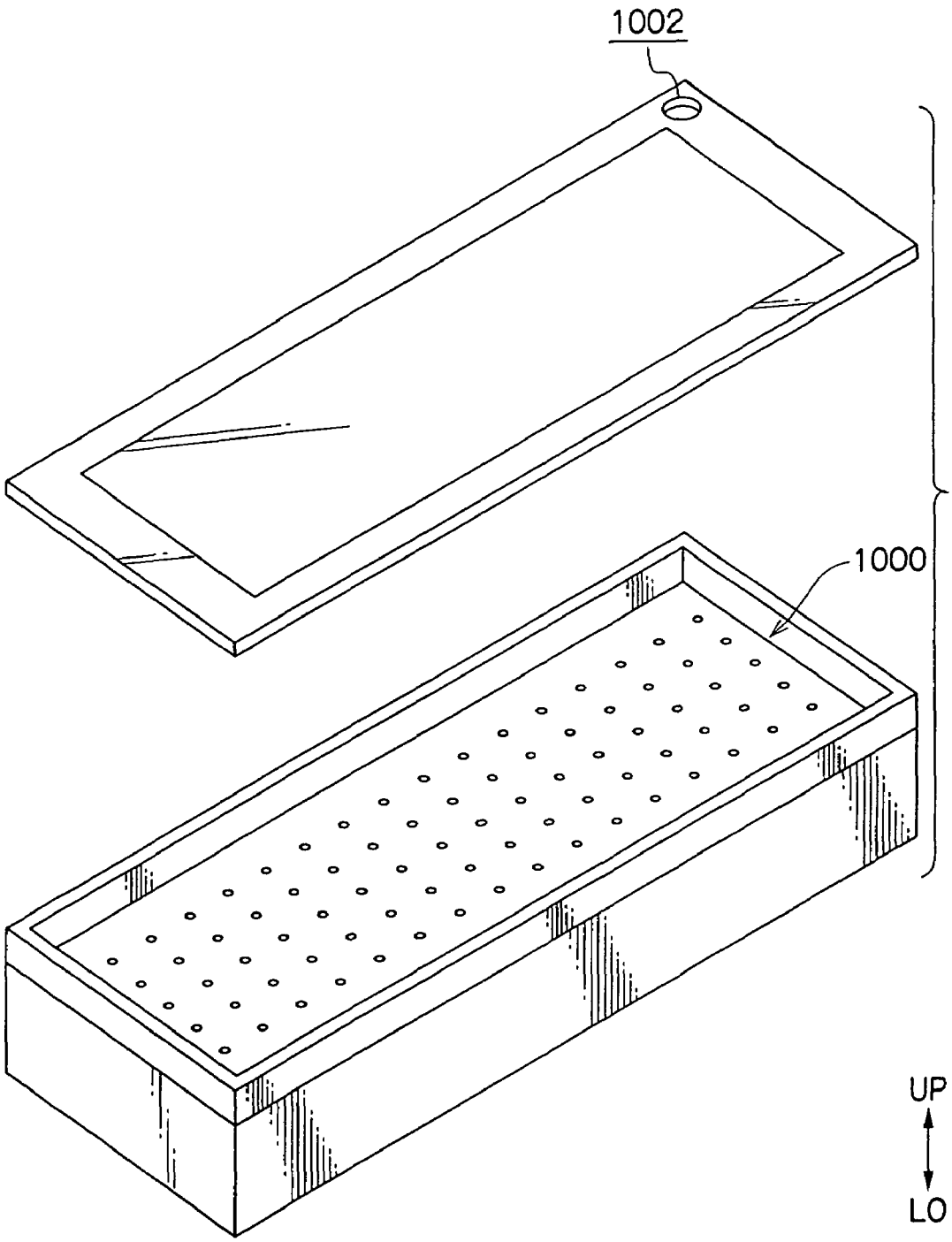
FIG.17 RELATED ART
FIG. 17 is an exploded perspective drawing showing the pattern of a conventional ink pool chamber.

Further, in the above-described embodiments, all of the current plates were arranged along each row of supply openings 67 or each line of supply openings 67, however, it is not necessary for these to be absolutely arranged between each row or each line. For example, as shown in FIG. 16, a current plate 205 can be arranged every two rows. Notably, when configuring the invention in this manner, the acoustic capacity increases so two effects can be achieved where cross talk can be more effectively suppressed and bubbles eliminated more smoothly.

Further, although not shown in the drawings, it is possible to make the current plates stand up from the top panel 40.

Furthermore, explanations of the inkjet recording device 10 of the above-described embodiment were made with an example of a partial width array (PWA) having the main scanning mechanism 16 and sub-scanning mechanism 18. Nonetheless, the inkjet recording in the present invention is not limited thereto, and can also be what is known as a full width array (FWA) recording that can correspond to the paper width. Actually, by making this FWA recording, the ink-pool chamber becomes wider so this can be applied even more favorably to the present invention.

Furthermore, the inkjet recording device 10 of the above-described embodiments was made such that an inkjet recording unit 30 each for black, yellow, magenta, and cyan, were mounted on a carriage 12, and recording performed by selectively discharging ink droplets from each inkjet recording head 32 onto the recording paper P based on image data.

Nonetheless, the inkjet recording in the present invention is not limited to the recording of characters and images on a recording paper P.

In other words, the recording medium is not limited to paper and the discharged liquid is not limited to ink. The inkjet recording head 32 and inkjet recording device 10 of the present invention can be applied to general liquid-spraying devices used industrially, such as those used when discharging ink onto polymer films and glass when making color filters for displays, or for when discharging solder in a welding state on a substrate when forming bumps for mounting parts.

With the inkjet recording head of the present invention, the supply openings can be lined and arranged in a matrix pattern at the undersurface of the ink pool chamber.

In such a case with the inkjet recording head of the present invention, since the supply openings are lined and arranged in a matrix pattern at the undersurface of the ink pool chamber, the current plates can be formed in a straight line. Accordingly, the ink in the ink pool chamber flows even smoother without stagnation.

With the inkjet recording head of the present invention, multiple current plates can be provided in parallel, and one end part and another end part of the current plate can alternately contact a side wall of the ink pool chamber.

With the inkjet recording head of the present invention, multiple current plates are provided in parallel, and one end part and another end part of the current plate alternately contact a side wall of the ink pool chamber. Accordingly, the flow of ink in the ink channel formed by the current plates becomes flow in one direction. Since there is no point where the ink flow collides, the ink in the ink pool chamber flows even smoother without stagnation.

With the inkjet recording head of the present invention, the current plate can be formed into a whirlpool pattern and one end part of the current plate can contact a side wall of the ink pool chamber.

With the inkjet recording head of the present invention, the current plate is formed into a whirlpool pattern and one end part of the current plate contacts a side wall of the ink pool chamber. Accordingly, the flow of ink in the ink channel formed by the current plates becomes one-way flow. Since there is no point where the ink flow collides, the ink in the ink pool chamber flows even smoother without stagnation.

With the inkjet recording head of the present invention, the ink pool chamber can be formed from multiple regions divided by the current plate and at least one of the injection ports can be provided in each of the regions.

With the inkjet recording head of the present invention, the ink pool chamber is formed from multiple regions divided by the current plate. Since the flow resistance in each of the regions is small, the flow of ink becomes even smoother.

With the inkjet recording head of the present invention, the drive IC that applies voltage to the piezoelectric element can be mounted to a piezoelectric element substrate that includes the vibration plate.

With the inkjet recording head of the present invention, the pressure chambers can be arranged to be in close proximity with each other, so the nozzles provided for each pressure chamber can be highly densely arranged. Further, minute wiring having a pitch of 10 μm or less can be formed for the metal wiring pulled out from the piezoelectric element using the photolithographic technology of a semiconductor process. Further, the vicinity of the piezoelectric element is connected with the drive IC, whereby the length of the wiring can be shortened (thereby decreasing the resistance of the wiring). Accordingly, high-resolution printing can be achieved.

Since the inkjet recording device of the present invention is provided with the above-described inkjet recording head, bubbles do not accumulate in the ink pool chamber. Accordingly, the ink droplets are stably discharged.

As explained above, with the present invention, an effect is achieved where the ink inside the ink pool chamber flows smoothly with no stagnation and bubbles are smoothly eliminated.

What is claimed is:

1. An inkjet recording head comprising:

a plurality of nozzles that are arranged in a matrix pattern and discharge ink droplets;

a plurality of pressure chambers that are communicated with each of the nozzles and into which ink is filled;

a vibration plate forming a portion of the pressure chambers;

a piezoelectric element that displaces the vibration plate;

an ink pool chamber that is provided at a side opposite to the pressure chambers with the vibration plate placed between the ink pool chamber and the pressure chambers and which accumulates ink supplied through ink supply paths communicated with each pressure chamber; wherein the ink pool chamber is provided with an injection port that injects ink into the ink pool chamber;

a plurality of supply openings of the ink supply paths provided at an undersurface of the ink pool chamber; and a current plate, which is provided along the supply openings, that forms a channel for ink injected from the injection port, the current plate extending from the undersurface of the ink pool chamber and into the ink pool chamber, and gaps are formed between the current plate and a top panel which faces a bottom of the ink pool chamber.

2. The inkjet recording head of claim 1, wherein the supply openings are lined and arranged in a matrix pattern at the undersurface of the ink pool chamber.

3. The inkjet recording head of claim 1, wherein the ink pool chamber has opposite side walls, and a plurality of the current plates are alternately arranged such that end parts of adjacent current plates contact opposite side walls.

4. The inkjet recording head of claim 1, wherein the current plate is formed into a whirlpool pattern and one end part of the current plate contacts a side wall of the ink pool chamber.

5. The inkjet recording head of claim 1, wherein the ink pool chamber is formed from a plurality of regions divided by the current plate and at least one of the injection ports is provided in each of the regions.

6. The inkjet recording head of claim 1, wherein a drive IC that applies voltage to the piezoelectric element is mounted to a piezoelectric element substrate that includes the vibration plate.

7. The ink jet recording head of claim 1, wherein the top panel has at least one portion which has capability of elastic deformation, and the top panel is a damper which damps down pressure waves that travel through ink in the ink pool chamber.

8. An inkjet recording device provided with an inkjet recording head comprising:

a plurality of nozzles that discharges ink droplets and are arranged in a matrix pattern;

a plurality of pressure chambers that are communicated with each of the nozzles and into which ink is filled;

a vibration plate forming a portion of the pressure chambers;

a piezoelectric element that displaces the vibration plate;

an ink pool chamber that is provided at a side opposite to the pressure chambers with the vibration plate placed between the ink pool chamber and the pressure chambers and which accumulates ink supplied through ink supply paths communicated with each pressure chamber; wherein the ink pool chamber is provided with an injection port that injects ink into the ink pool chamber;

a plurality of supply openings of the ink supply paths provided at an undersurface of the ink pool chamber; and a current plate, which is provided along the supply openings, that forms a channel for ink injected from the injection port, and gaps are formed between the current plate and a top panel which faces a bottom of the ink pool chamber.

9. The inkjet recording device of claim 8, wherein the supply openings of the inkjet recording head are lined and arranged in a matrix pattern at the undersurface of the ink pool chamber.

10. The inkjet recording device of claim 8, wherein the ink pool chamber has opposite side walls, and a plurality of the current plates are alternately arranged such that end parts of adjacent current plates contact opposite side walls.

11. The inkjet recording device of claim 8, wherein the current plate of the inkjet recording head is formed into a whirlpool pattern and one end part of the current plate contacts a side wall of the ink pool chamber.

12. The inkjet recording device of claim 8, wherein the ink pool chamber of the inkjet recording head is formed from a plurality of regions divided by the current plate and at least one of the injection ports is provided in each of the regions.

13. The inkjet recording device of claim 8, wherein a drive IC of the inkjet recording head that applies voltage to the piezoelectric element is mounted to a piezoelectric element substrate that includes the vibration plate.

* * * * *